US008141991B2

(12) United States Patent
Kato et al.

(10) Patent No.: US 8,141,991 B2
(45) Date of Patent: Mar. 27, 2012

(54) LIQUID EJECTING HEAD, LIQUID EJECTING APPARATUS, AND PIEZOELECTRIC ACTUATOR

(75) Inventors: Jiro Kato, Suwa (JP); Satoshi Denda, Suwa (JP); Ichiro Asaoka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 291 days.

(21) Appl. No.: 12/635,199

(22) Filed: Dec. 10, 2009

(65) Prior Publication Data

US 2010/0149285 A1 Jun. 17, 2010

(30) Foreign Application Priority Data

Dec. 11, 2008 (JP) ..... 2008-316299

(51) Int. Cl.
*B41J 2/045* (2006.01)

(52) U.S. Cl. ..... 347/71

(58) Field of Classification Search ..... 347/71, 347/68–69, 70, 72; 400/124.14, 124.16; 310/311, 324, 327, 358, 365; 204/192.18; 427/100

See application file for complete search history.

(56) References Cited

U.S. PATENT DOCUMENTS

| | | | | |
|---|---|---|---|---|
| 7,562,968 | B2 * | 7/2009 | Sumi et al. | 347/68 |
| 7,878,631 | B2 * | 2/2011 | Kuriki et al. | 347/68 |
| 7,896,480 | B2 * | 3/2011 | Kazama et al. | 347/68 |
| 7,918,543 | B2 * | 4/2011 | Kazama et al. | 347/68 |

FOREIGN PATENT DOCUMENTS

| | | | |
|---|---|---|---|
| CN | 1338377 | A | 3/2002 |
| CN | 1471181 | A | 1/2004 |
| JP | 2003-127366 | | 5/2003 |
| JP | 2005-209722 | | 8/2005 |
| JP | 2008-258575 | | 10/2008 |

* cited by examiner

*Primary Examiner* — Kristal Feggins
(74) *Attorney, Agent, or Firm* — Workman Nydegger

(57) ABSTRACT

A liquid ejecting head includes a pressure generating chamber that communicates with a nozzle opening and a piezoelectric element that includes: a first electrode; a piezoelectric body layer that is formed on the first electrode and which has a perovskite structure with a general formula of $ABO_3$, and a second electrode that is formed the piezoelectric body layer. There is lead in a B site of the piezoelectric body layer, and the peak position of $A_1(3LO)$ for a Raman shift of the piezoelectric body layer that is acquired by Raman scattering is 710 $cm^{-1}$ to 712 $cm^{-1}$.

13 Claims, 8 Drawing Sheets

LIQUID EJECTING HEAD, LIQUID EJECTING APPARATUS, AND PIEZOELECTRIC ACTUATOR

CROSS-REFERENCES AND RELATED APPLICATIONS

The entire disclosures of Japanese Patent Application No. 2008-316299, filed Dec. 11, 2008 is expressly incorporated herein by reference.

BACKGROUND OF THE INVENTION

1. Technical Field

The present invention relates to a liquid ejecting head, a liquid ejecting apparatus, and a piezoelectric actuator. More specifically, the present invention relates to a liquid ejecting head, liquid ejecting apparatus, and piezoelectric actuator which include a piezoelectric element with a first electrode, a piezoelectric body layer, and a second electrode.

2. Related Art

Piezoelectric actuators are often used in liquid ejecting heads and liquid ejecting apparatuses in order to change the pressure of the liquid in order to cause the liquid to be ejected. The piezoelectric actuator typically include a piezoelectric body layer disposed between a plurality of electrodes and is formed from a piezoelectric material with a electromechanical conversion function, such as a material containing lead, zirconium, and titanium such as lead zirconium titanate (PZT). An example of such a piezoelectric actuator is found in Japanese Application No. JP-A-2003-127366.

As the demand for higher image quality and higher speed liquid ejecting apparatuses has increased, however, a need has arisen for a liquid ejecting head that can acquire a large piezoelectric displacement using a low driving voltage.

In addition, one problem with the configurations currently known in the art is that the piezoelectric body layer often becomes degraded due to a leakage current or the like. Accordingly, there is a need for a more durable liquid ejecting head.

In addition, the above-described problem is not limited to the piezoelectric actuators used in a liquid ejecting head and also exists in a piezoelectric actuators that are used in devices other than the liquid ejecting head.

BRIEF SUMMARY OF THE INVENTION

An advantage of some aspects of the invention is that it provides a liquid ejecting head, a liquid ejecting apparatus, and a piezoelectric actuator that include a piezoelectric element with a first electrode, a piezoelectric body layer, and a second electrode.

A first aspect of the invention is provided a liquid ejecting head including a pressure generating chamber that communicates with a nozzle opening and a piezoelectric element that includes a first electrode, a piezoelectric body layer that is formed on the first electrode and which has a perovskite structure with a general formula of $ABO_3$, and a second electrode that is formed the piezoelectric body layer. There is lead in a B site of the piezoelectric body layer, and the peak position of $A_1$(3LO) for a Raman shift of the piezoelectric body layer that is acquired by Raman scattering is 710 $cm^{-1}$ to 712 $cm^{-1}$.

According to the above-described liquid ejecting head, a liquid ejecting head can be acquired that has superior piezoelectric characteristics, such as the amount of piezoelectric displacement, and superior degradation characteristics, such as a breakdown voltage and film-peel-off.

A second aspect of the invention is a liquid ejecting apparatus including the above-described liquid ejecting head.

A third aspect of the invention is a piezoelectric actuator including a piezoelectric element that includes a first electrode, a piezoelectric body layer that is formed on the first electrode and which has a perovskite structure with a general formula of $ABO_3$, and a second electrode that is formed on the piezoelectric body layer. There is lead in a B site of the piezoelectric body layer, and the peak position of $A_1$ (3LO) for Raman shift of the piezoelectric body layer that is acquired by Raman scattering is 710 $cm^{-1}$ to 712 $cm^{-1}$.

According to the above-described piezoelectric actuator, a piezoelectric body layer that has superior piezoelectric characteristics and degradation characteristics such as a breakdown voltage and film-peel-off can be acquired.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail, so as to describe the invention. As may be understood by one of skill in the art, however, the embodiments described herein may be modified without departing from the scope and meaning of the claims. As such, the following embodiments are illustrative only and do not limit the scope of the claims.

Embodiment 1

Figure 1:
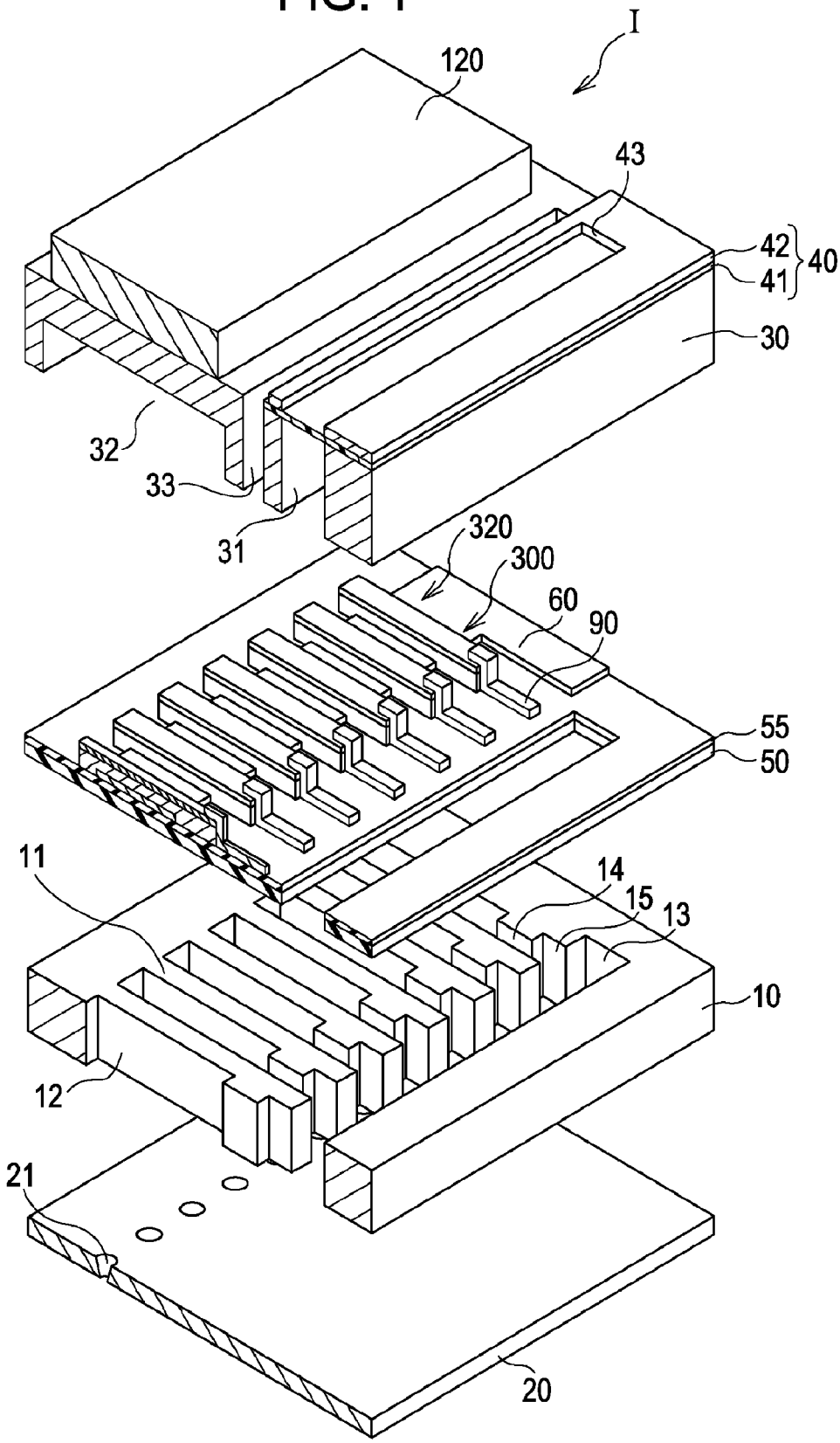
FIG. 1 is an exploded perspective view schematically showing the configuration of a recording head according to first embodiment of the invention.
Figure 2A:
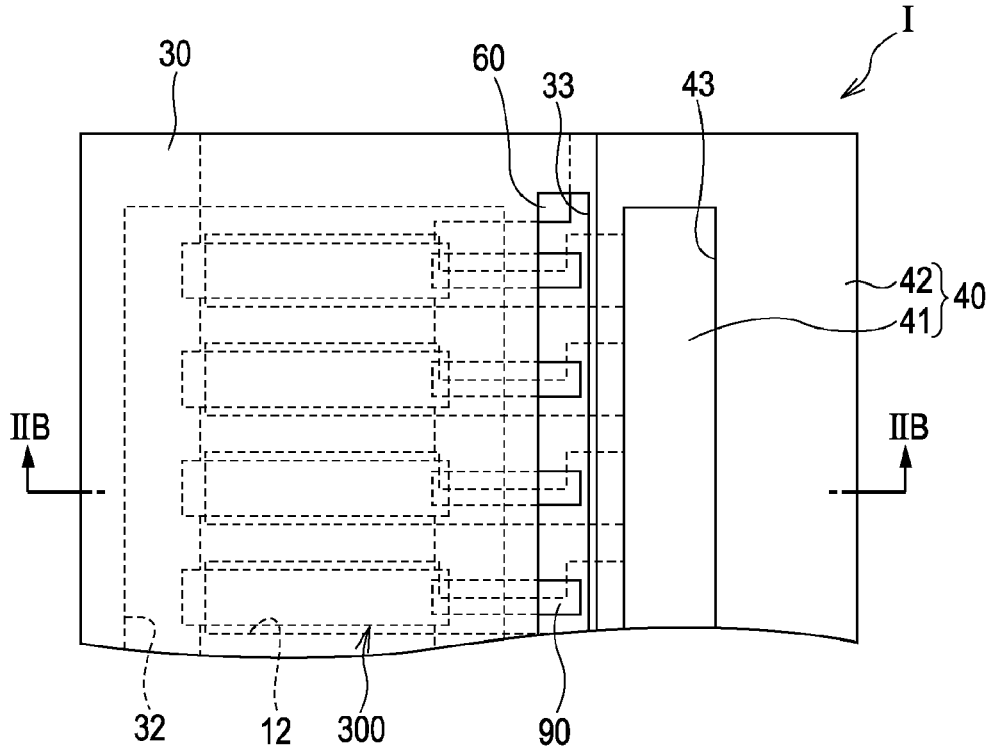
FIGS. 2A and 2B are a plan view and a cross-sectional view of the recording head according to the first embodiment.
Figure 2B:
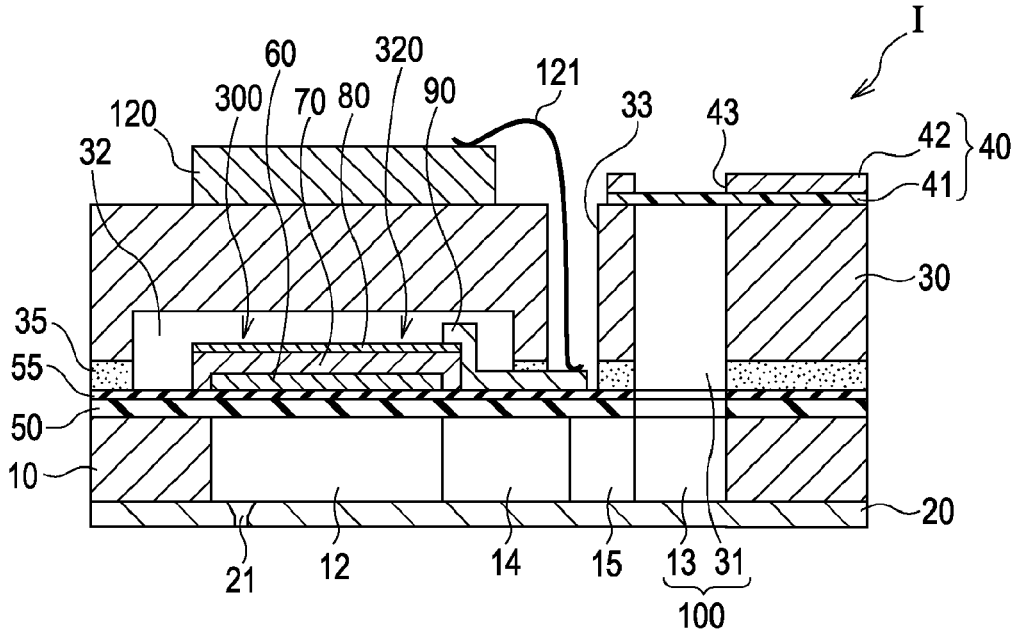

FIG. 1 is an exploded perspective view schematically showing the configuration of an ink jet recording head as an example of a liquid ejecting head according to a first embodiment of the invention. FIGS. 2A and 2B are a plan view of FIG. 1 and a cross-sectional view taken along line IIB-IIB shown in FIG. 2A.

As shown in the above-described figures, a flow path forming substrate 10 according to this embodiment is formed from a silicon monocrystal substrate with a plane orientation of (110). An elastic film 50 is formed from silicon dioxide on one face of the flow path forming substrate 10 with a thickness of 0.5 to 2 μm using thermal oxidation.

Pressure generating chambers 12 are formed in the flow path forming substrate 10 and are separated using a plurality of partition walls 11 which are arranged in the width direction (short side direction) of the flow path forming substrate 10 by performing an anisotropic etching process on the flow path forming substrate on the side of the substrate opposite to the elastic film 50. Ink supply paths 14 and communication paths 15 are formed in one end of the flow path forming substrate 10 so as to communicate with the pressure generating chamber 12 and are partitioned by the partition walls 11. At one end of the communication paths 15, a communication portion 13 is formed that configures a part of a reservoir 100 that becomes a common ink chamber (liquid chamber) of the pressure generating chambers 12. In other words, liquid flow paths are formed in the flow path forming substrate 10, each including a pressure generating chamber 12, a communication portion 13, an ink supply path 14, and a communication path 15.

The ink supply path 14 communicates with one end of the pressure generating chamber 12 in the longitudinal direction and has a cross-sectional area that is smaller than that of the pressure generating chamber 12. In this embodiment, the ink supply path 14 has a width smaller than that of the pressure generating chamber 12, which is formed by extending the width of the partition wall 11 so as to narrow the flow path on the pressure generating chamber 12 side between the reservoir 100 and the pressure generating chamber 12 in the width direction. As described above, in the embodiment of the invention shown in FIG. 1, the ink supply path 14 is formed by narrowing one side of the flow path. Alternatively, however, the ink supply path may be formed by narrowing the width of the flow path from both sides. Furthermore, the ink supply path may be formed not by narrowing the width of the flow path but by narrowing the flow path in the thickness direction.

Each communication path 15 communicates with the side of the ink supply path 14 that is located opposite to the pressure generating chamber 12 and has a cross-sectional area that is larger than that of the ink supply path 14 in the width direction (short side direction). In this embodiment, the communication path 15 is formed so as to have a cross-sectional area that is the same as that of the pressure generating chamber 12.

In other words, in the flow path forming substrate 10, the pressure generating chambers 12, the ink supply paths 14, that have a cross-sectional area which is smaller than that of the pressure generating chamber 12 in the width direction. The communication paths 15, which communicate with the ink supply paths 14 and each have a cross-sectional area larger than that of the ink supply path 14 in the width direction, are arranged so as to be partitioned by the plurality of partition walls 11.

A nozzle plate 20 is fixed using an adhesive agent, thermal welding film, or the like to the opening face side of the flow path forming substrate 10. Nozzle openings 21 are formed in the nozzle plate 20 so as to communicate with an area near the end portion of one of the pressure generating chambers 12 on the side opposite to the ink supply path 14. The nozzle plate 20 is formed, for example, of a glass ceramic, a silicon monocrystal substrate, stainless steel or the like so as to have a thickness of 0.01 to 1 mm and a linear expansion coefficient of 2.5 to 4.5 [$\times 10^{-6}$/° C.] at temperatures of equal to or less than 300° C.

The elastic film 50 is formed as described above with a thickness of, for example, about 1.0 μm on the opposite surface of the path forming substrate, as described above. An insulating film 55, with a thickness of, for example, about 0.4 μm, is formed on the elastic film 50. In addition, on the insulating film 55, a first electrode 60 with a thickness of, for example, about 0.2 μm, a piezoelectric body layer 70 with a thickness of, for example, about 1.1 μm, and a second electrode 80 with a thickness of, for example, about 0.05 μm are formed in a stacked configuration by performing processes described more fully below so as to form a piezoelectric element 300. Here, the piezoelectric element 300 is the portion that includes the first electrode 60, the piezoelectric body layer 70, and the second electrode 80. Generally, while one electrode of the piezoelectric element 300 is used as a common electrode, the other electrode and the piezoelectric body layer 70 are configured by being patterned so as to correspond with each pressure generating chamber 12. A piezoelectric body active portion 320 is a portion that is formed so as to correspond to an electrode and the piezoelectric body layer 70 where piezoelectric deformation is generated due to the application of a voltage between both the electrodes. In this embodiment, the first electrode 60 is used as the common electrode of the piezoelectric element 300, and the second electrode 80 is used as an individual electrode of the piezoelectric element 300. However, the first electrode 60 and the second electrode 80 may be used in an opposite configuration, depending on the specific configuration of the driving circuit or wirings used.

The piezoelectric element 300 and a vibration plate that is displaced in accordance with the driving of the piezoelectric element 300 are referred to as a piezoelectric actuator. In this example, the elastic film 50, the insulating film 55, and the first electrode 60 act as a vibration plate. However, it is apparent that the invention is not limited to this configuration and that various other embodiments may be used. For example, only the first electrode 60 may be configured to act as the vibration plate without requiring the use of the elastic film 50 and the insulating film 55. Alternatively, the piezoelectric element 300 may be configured to also substantially serve as the vibration plate.

It is preferable that the first electrode 60 contains platinum (Pt). In addition, platinum (Pt) is selected as a material that does not lose conductivity through a high-temperature heat treatment even when the first electrode 60 is heated together with the piezoelectric body layer 70 during the baking process used to form the piezoelectric body layer 70. In addition, the first electrode 60 may also include iridium, iridium oxide, or the like. Here, iridium is selected as a material for preventing the material which forms the piezoelectric body layer 70 from diffusing into the first electrode 60 during a high-temperature heating process performed to form the piezoelectric body layer 70.

The piezoelectric body layer 70 is formed on the first electrode and comprises a crystallized film with a perovskite structure which is formed of a piezoelectric material of an oxide, represented by a general formula of "$ABO_3$", with a polarized structure. Here, for the general formula of $ABO_3$, the position of A is referred to as an A site, and the position of B is referred to as a B site. A ferroelectric material such as lead zirconium titanate (PZT) or the ferroelectric material to which a metal oxide such as niobe oxide, nickel oxide, or magnesium oxide is added may be also used for the piezoelectric body layer 70. In particular, lead titanate ($PbTiO_3$), lead zirconate titanate (Pb(Zr, Ti) $O_3$), lead zirconate ($PbZrO_3$), lead lanthanum titanate ((Pb, La), $TiO_3$), lead lanthanum zirconate-titanate ((Pb, La) (Zr, Ti) $O_3$), lead magnesium niobate zirconium titanate (Pb(Zr, Ti) (Mg, Nb) $O_3$) or the like may be used for the piezoelectric body layer 70.

The thickness of the piezoelectric body layer 70 is suppressed so as suppress cracks in the manufacturing process, and the piezoelectric body layer 70 is formed to be thick enough to exhibit sufficient displacement characteristics. For example, in this embodiment, the piezoelectric body layer 70, which is formed from PZT, is formed to have a thickness of about 1 to 2 μm.

In addition, the piezoelectric body layer has a Raman shift that can be acquired by Raman scattering measured by using He—Cd laser as an excitation laser, such that the peak position of $A_1$(3LO) in the piezoelectric body layer 70 is 710 $cm^{-1}$ to 712 $cm^{-1}$. The Raman shift represents a wave number difference between the incident light and the Raman-scattered light. In this embodiment, the measurement of the Raman scattering is a result that was measured at a room temperature with non-polarization. A three-dimensional microscopic laser Raman spectrometer (Nanofinder@30, manufactured by Tokyo Instruments Inc.) was used to measure the Raman shift.

In addition, it is preferable that the piezoelectric body layer 70 has a ratio of titanium (the density of titanium) to the sum of titanium and zirconium of 0.464 to 0.6 (46.4% to 60%). In other words, it is preferable that the piezoelectric body layer 70 is formed from $Pb(Zr_xTi_{1-x})O_3$ wherein X=0.464 to 0.6. As described more fully below, although the peak position of $A_1$(3LO) of the Raman shift caused by the Raman scattering in the piezoelectric body layer 70 changes depending on a difference in the density of titanium, the change in the Raman shift can be suppressed so as to be within the range of the measurement error for the above-described range of the density of titanium. This results in a piezoelectric body layer 70 with superior piezoelectric characteristics and degradation characteristics.

The above-described piezoelectric body layer 70 can be formed, for example, using a so-called sol-gel method in which the piezoelectric body layer 70 formed from metal oxide is acquired by, for example, dissolving and dispersing an organic metal compound into a solvent, coating and drying a so-called sol so that it becomes a gel, and baking the gel at a higher temperature. In addition, the method of manufacturing the piezoelectric body layer 70 is not limited to the so-called sol-gel method, and other methods may be used. For example, an MOD (Metal Organic Deposition) method, a sputtering method, or the like may be used. The piezoelectric body layer 70 of which the peak position of $A_1$(3LO) becomes 710 $cm^{-1}$ to 712 $cm^{-1}$ for the Raman shift acquired by the above-described Raman scattering can be acquired, for example, by adjusting the amount of lead contained in a solution such as sol forming the piezoelectric body layer 70 and appropriately adjusting the baking temperature and time when the sol-gel method or the MOD method is used.

Figure 3A:
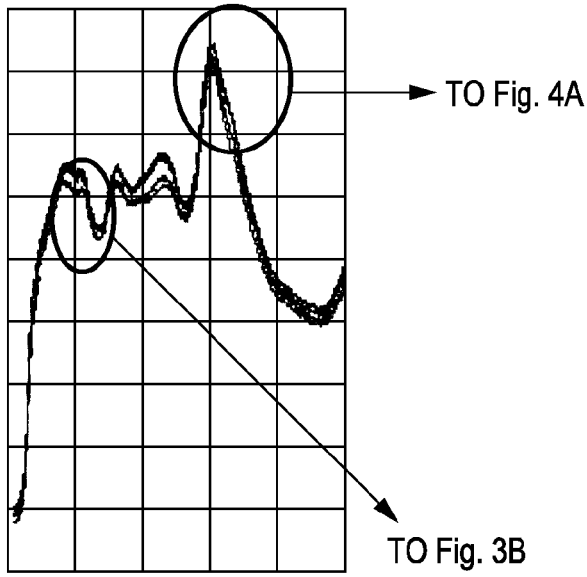
FIGS. 3A and 3B are graphs showing the measurement result of Raman scattering for a piezoelectric body layer according to the first embodiment.
Figure 3B:
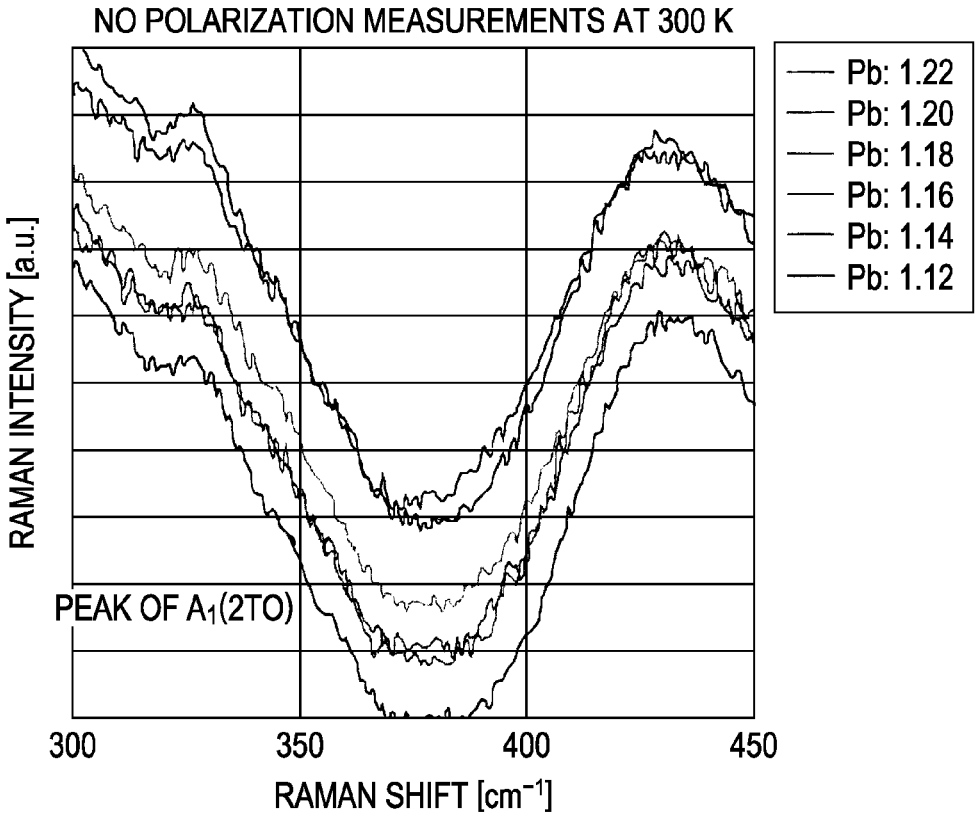
Figure 4A:
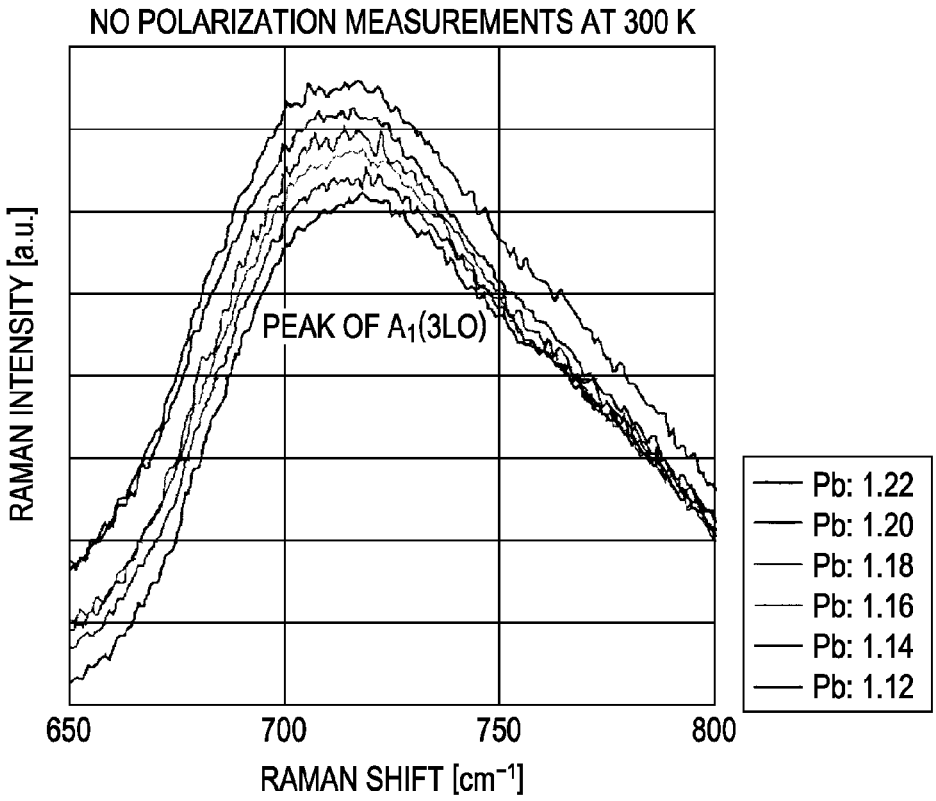
FIGS. 4A and 4B are graphs showing the measurement result of Raman scattering for a piezoelectric body layer according to the first embodiment.
Figure 4B:
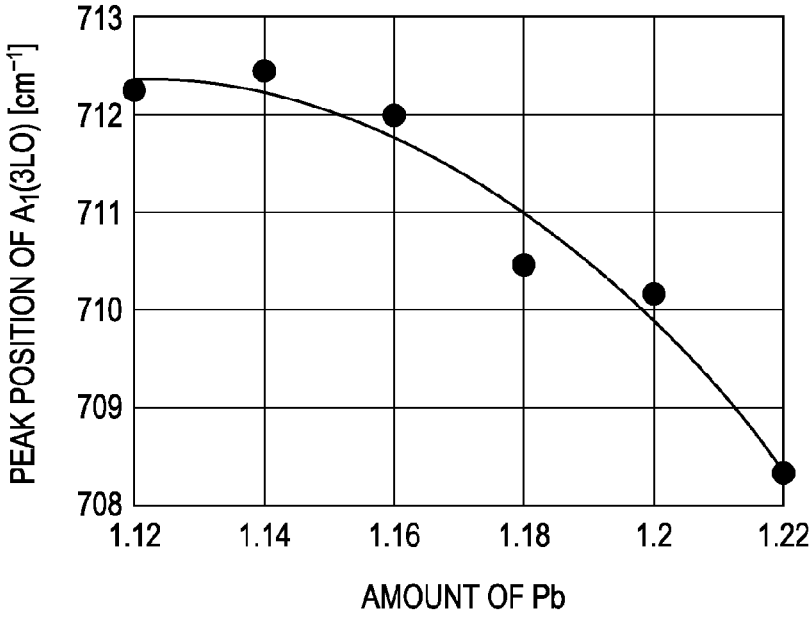

Here, in this embodiment, the PZT in which the density of titanium is 52% (0.52) is formed by using the sol-gel method. At the time when the PZT is formed, a total of six solutions are prepared which are acquired by changing the amount of excessive lead contained in each solution forming the piezoelectric body layer 70 by 2% in the range of 12% to 22%, and the piezoelectric body layers 70 are formed using the solutions. In addition, the temperature and the time for which the piezoelectric body layer 70 is baked are fixed. Here, the Raman scattering of each piezoelectric body layer 70 was measured. The results are shown in FIGS. 3A and 3B. FIG. 3A illustrates the measurement results of the Raman scattering. FIG. 3B is a graph acquired by enlarging the peak position of $A_1$(2TO) for the Raman shift shown in FIG. 3A. FIG. 4A is a graph acquired by enlarging the peak position of $A_1$(3LO) for the Raman shift shown in FIG. 3A. FIG. 4B is a graph showing the relationship between the amount of excessive lead and the peak position of $A_1$(3LO) for the Raman shift.

Experimental Results

Among the piezoelectric body layers acquired as described above, the piezoelectric body layer in which the peak position of $A_1$(3LO) for the Raman shift acquired by the Raman scattering is 710.17 $cm^{-1}$ will be referred to as Example 1, and the piezoelectric body layer in which the peak position of $A_1$(3LO) is 711.99 $cm^{-1}$ for the Raman shift will be referred to as Example 2. In addition, for the Raman shift acquired by the Raman scattering in the same manner, the piezoelectric body layer in which the peak position of $A_1$(3LO) is 708.35 $cm^{-1}$ will be represented as Example 3, and the piezoelectric body layer in which the peak position of $A_1$(3LO) is 712.44 $cm^{-1}$ will be represented as Example 4.

Then, the amounts of piezoelectric displacement, the breakdown voltages, and the adhesion strengths of the piezoelectric body layers in Examples 1-4 were measured. The result is shown below in Table 1 and FIGS. 5 to 7.

In addition, the amount of piezoelectric displacement of each piezoelectric body layer is measured by using a laser interferometer (such as aixDBLI manufactured by aixACCT) by installing a metal mask on a sample surface and applying a voltage between a second electrode formed by using an Ir sputtering method and a first electrode formed below the piezoelectric body layer so as to generate transformation. The breakdown voltage of each piezoelectric body layer is measured by using an LCR meter (such as 12096W manufactured by Toyotechnica). In addition, the adhesion strength of each piezoelectric layer is measured by using a thin-film adhesion strength measuring device (such as RomulusIV manufactured by QUAD GROUP) based on an experiment complying with a Sebastian method.

TABLE 1

| | Example 1 | Example 2 | Example 3 | Example 4 |
|---|---|---|---|---|
| Peak Position [$cm^{-1}$] | 710.17 | 711.99 | 708.35 | 712.44 |
| Amount of Piezoelectric Displacement [nm] | 3.46 | 2.27 | 3.73 | 1.95 |
| Breakdown Voltage [V] | 62.2 | 78.2 | 41.2 | 76.3 |
| Adhesion Strength [$kg/cm^2$] | 663 | 581 | 369 | 558 |

Figure 5:
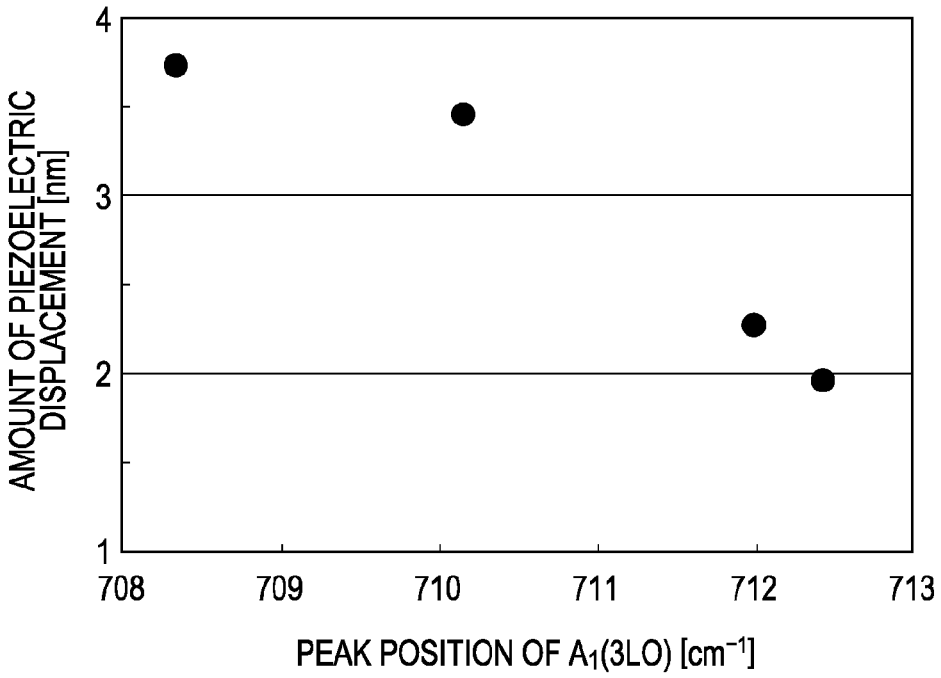
FIG. 5 is a graph showing the experimental result for the first embodiment.
Figure 6:
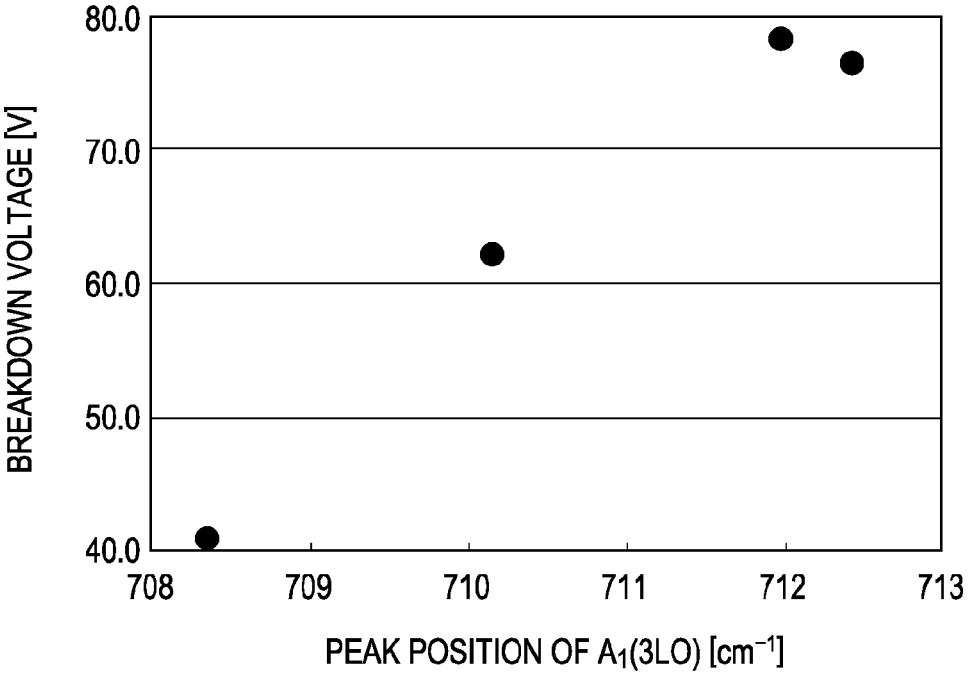
FIG. 6 is a graph showing the experimental result for the first embodiment.
Figure 7:
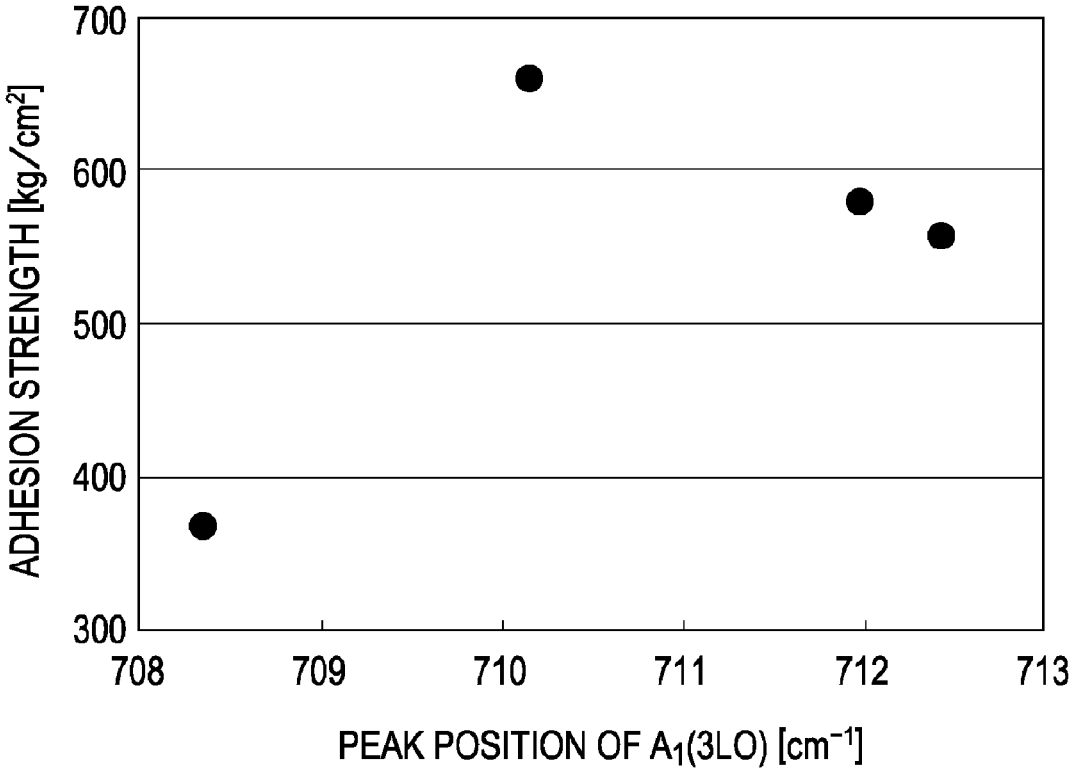
FIG. 7 is a graph showing the experimental result for the first embodiment.

As shown in FIG. 5, it can be noticed that the amounts of piezoelectric displacement of the piezoelectric body layer of Examples 1 and 2 and Example 3 are superior to that of Example 4. In addition, as shown in FIGS. 6 and 7, it can be noticed that the breakdown voltages and the adhesion strengths of Experiment Examples 1 and 2 and Example 4 are much superior to that of Example 3.

Accordingly, by configuring the peak position of $A_1$(3LO) in the piezoelectric body layer for the Raman shift acquired by the Raman scattering to be 710 $cm^{-1}$ to 712 $cm^{-1}$, a piezoelectric body layer can be formed with superior piezoelectric characteristics, such as the displacement amount, and superior degradation characteristics, such as the breakdown voltage and the adhesion strength.

Here, the reason why the piezoelectric body layer with the superior piezoelectric characters such as the displace amount and the superior degradation characteristics can be acquired by configuring the peak position of $A_1$(3LO) for the Raman shift acquired by Raman scattering to be 710 $cm^{-1}$ to 712 $cm^{-1}$ as described above is likely due to the influence of the amount of lead contained in the B site of the piezoelectric body layer with the perovskite structure.

Even when the amount of excessive lead of the solution that forms the piezoelectric body layer is changed by 2% each time within the range of 12% to 22%, although the shift of the peak of $A_1$(2TO) that vibrates the entire lattice of the piezoelectric body layer (PZT) was not observed as shown in FIG. 3B, as shown in FIGS. 4A and 4B, the shift of the peak of $A_1$(3LO) that actively vibrates the B site of the piezoelectric body layer was observed. In other words, it was known that a part of the excessive lead contained in the solution is mixed into the B site of the PZT. However, not all of the excessive lead contained in the solution is mixed into the B site, and some of the excessive lead is mixed into spaces between the lattices, grains, and the like of the PZT. Since a case where zirconium (Zr) or titanium (Ti) exists in the B site is much more stable than a case where lead (Pb) exists therein, from the viewpoint of energy, and accordingly, it is practically difficult to regard that most of the excessive lead exists in the B site.

The amount of lead that exists in the B site is calculated based on the amount of the shift of the peak of $A_1$(3LO). First, Table 2 shows the average mass of the B site at the time of the existence of lead is calculated based on the mass numbers of the ingredients constituting the PZT. Here, the mass numbers of Ti, Zr, Pb, and that constitute the PZT are 47.867, 91.224, 207.2, and 16.0. In addition, in this embodiment, the density of Ti is calculated as 52% as described above.

TABLE 2

| Pb [%] of B Site | Average Mass of B Site |
|---|---|
| 0 | 68.67836 |
| 0.25 | 69.0246641 |
| 0.5 | 69.3709682 |
| 0.75 | 69.7172723 |
| 1 | 70.0635764 |
| 1.5 | 70.7561846 |
| 2 | 71.4487928 |
| 2.5 | 72.141401 |
| 3 | 72.8340092 |
| 3.5 | 73.5266174 |
| 4 | 74.2192256 |

Since the B site is bonded to oxygen, the frequency is calculated by calculating the reduced mass of the average mass of oxygen and atoms of the B site using Table 2. The frequency is in proportion to the following Equation (1) wherein k is a constant of spring and μ is the reduced mass.

Equation (1)

$$\sqrt{K/\mu} \quad (1)$$

Here, when the amount of the excessive lead contained in the solution that forms the piezoelectric body layer is lower than 12%, the piezoelectric characteristics are extremely degraded. Accordingly, the amount of lead contained the B site can be regarded to be zero when the amount of the excessive lead contained in the solution is 12%. At this moment, the relationship between the amount of the excessive lead contained in the B site and the peak position (frequency) is the same as the results shown below in Table 3, represented in FIG. 8.

TABLE 3

| Pb [%] of B Site | Peak Position [$cm^{-1}$] |
|---|---|
| 0 | 712.4 |
| 0.25 | 712.0622481 |
| 0.5 | 711.7277105 |
| 0.75 | 711.3963414 |
| 1 | 711.0680959 |
| 1.5 | 710.4208002 |
| 2 | 709.7854807 |
| 2.5 | 709.1618074 |
| 3 | 708.5494622 |
| 3.5 | 707.9481385 |
| 4 | 707.357541 |

Accordingly, for example, the peak position of $A_1$(3LO) of the piezoelectric body layer 70 that is formed from the solution with the 22% amount of excessive lead is 708.3 $cm^{-1}$, as shown in FIG. 4A. Similarly, Table 3 illustrates that the amount of lead contained in the B site is between 3% to 3.5%.

Figure 8:
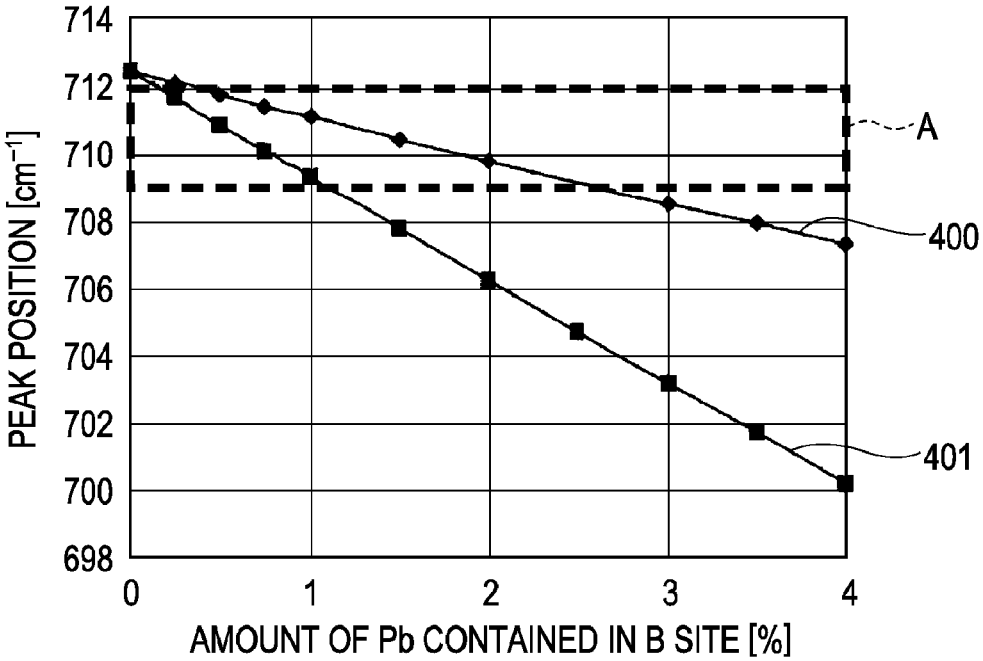
FIG. 8 is a graph showing the measurement result of Raman scattering for the piezoelectric body layer according to the first embodiment.

The calculation is performed by using the fixed spring constant k regardless of the amount of lead contained in the B site. However, when lead exists in the B site, the spring constant k is thought to be small. According to the first principle calculation, the orbital energy of the 5d orbital of Pb and the energy of the 2s orbital of oxygen are identical to each other, whereby a sufficient bonding state is formed. When the bonding strength (the constant k of spring) between lead and oxygen in the B site is half of the bonding strength between Ti or Zr and oxygen, the result shown in FIG. 8 is acquired. In FIG. 8, the relationship between the amount of lead of the B site and the peak position of $A_1$(3LO) for a fixed spring constant k is denoted by line 400, and the relationship for a spring constant k is ½ is denoted by line 401. As described more fully below, FIG. 8 also illustrates the peak position of the piezoelectric body layer 70 with the superior piezoelectric characteristics and degradation characteristics as denoted by area A.

As shown in FIG. 8, line 400 designates the case where the spring constant k is assumed not to change. It is preferable that the amount of the excessive lead contained in the B site is equal to or larger than 0.25% and is smaller than 2.7% in order to form a piezoelectric body layer 70 with superior piezoelectric characteristics and degradation characteristics. In addition, even when the spring constant k becomes ½, when the amount of the excessive lead contained in the B site is equal to or larger than 0.25% and is smaller than 2.7%, as denoted by the line 401, the peak position is located in the area A so that the piezoelectric body layer 70 has superior piezoelectric characteristics and the degradation characteristics. Accordingly, by configuring the amount of the excessive lead contained in the B site of the piezoelectric body layer 70 to be equal to or larger than 0.25% and smaller than 2.7% without considering the spring constant k, it is possible to form a piezoelectric body layer 70 with the superior piezoelectric characteristics and degradation characteristics.

In addition, the peak position of $A_1$(3LO) for the Raman shift in the piezoelectric body layer 70 in Raman scattering changes in accordance with the density of titanium. Here, the piezoelectric body layer 70 was formed by using a solution that has 18% excessive lead. A plurality of piezoelectric body layers was formed by changing the ratio of titanium to the sum of titanium and zirconium, that is, the density of titanium at that moment. Then, the peak position of $A_1$(3LO) for the Raman shift of each piezoelectric body layer in Raman scattering was measured. The result of the measurement is shown in Table 4 and FIG. 9 represented below.

TABLE 4

| Ti/(Ti + Zr) | Peak Position [$cm^{-1}$] |
|---|---|
| 0.464 | 709.9 |
| 0.484 | 709.8 |
| 0.49 | 711.1 |
| 0.51 | 711.3 |
| 0.53 | 710.5 |
| 0.55 | 711.3 |
| 0.6 | 711.52 |
| 0.65 | 710.5 |
| 0.7 | 715.1 |
| 0.8 | 717 |

Figure 9:
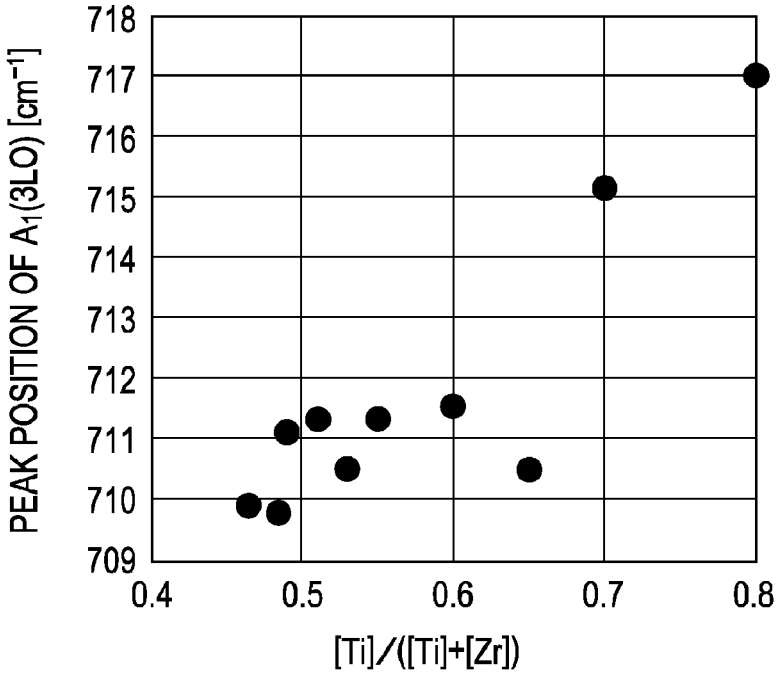
FIG. 9 is a graph showing the calculation result for the first embodiment.

As shown in Table 4 and FIG. 9, the amount of lead contained in the B site after formation of the piezoelectric body layer 70 is almost constant for the density of titanium of 46.6% to 60%. Here, although the peak position of $A_1$(3LO) of the Raman shift in Raman scattering is changed depending on the density of titanium, 46.6% to 60% is merely a difference which is of the degree that can be considered to be within the range of the measurement error. Accordingly, for a piezoelectric body layer 70 with the density of titanium being 46.6% to 60%, has the same properties as the piezoelectric body layer 70 with the density of titanium of 52%. In other words, when the peak position of $A_1$(3LO) of the Raman shift in Raman scattering is 710 $cm^{-1}$ to 712 $cm^{-1}$, the piezoelectric body layer 70 has the superior piezoelectric characteristics and degradation characteristics.

Here, the amount of lead contained in the B site cannot be adjusted only by adjusting the amount of excessive lead of the solution. The reason is as follows. When the temperature for baking the piezoelectric body layer 70 is relatively high, the volatilization of lead is promoted. On the other hand, when the baking temperature is relatively low, the amount of volatilized lead is suppressed. Accordingly, in order to adjust the amount of lead contained in the B site to be in a desired range, the amount of excessive lead of the solution, the baking temperature, the baking time, and the like need to be appropriately adjusted. In addition, by adjusting the peak position of $A_1$(3LO) of the Raman shift in the piezoelectric body layer 70 in Raman scattering to 710 $cm^{-1}$ to 712 $cm^{-1}$, the amount of lead contained in the B site of the piezoelectric body layer 70 can be regulated so as to be in a desired range (in this embodiment, 0.25% to 2.7%).

A lead electrode 90, formed of for example, gold (Au) or the like, is drawn out from near the end portion located on the ink supply path 14 side so as to extend to the insulating film 55 and connect to each second electrode 80 that is an individual electrode of the piezoelectric element 300.

On the flow path forming substrate 10 on which the above-described piezoelectric element 300 is formed, that is, on the first electrode 60, the elastic film 50, and the lead electrode 90, a protection substrate 30, which has a reservoir portion 31 that constitutes at least a part of the reservoir 100, is bonded through an adhesive agent 35. The reservoir portion 31, in this embodiment, is formed so as to perforate the protection substrate 30 in the thickness direction and extend in the width direction of the pressure generating chamber 12 and communicate with the communication portion 13 of the flow path forming substrate 10 as described above to form the reservoir 100 which is a common ink chamber for the pressure generating chambers 12.

A piezoelectric element holding portion 32 is formed in an area of the protection substrate 30 that faces the piezoelectric elements 300 and includes a space that does not block the movement of the piezoelectric elements 300. So long as the piezoelectric element holding portion 32 has a space that does not block the movement of the piezoelectric elements 300, the space may be sealed or may not be sealed.

It is preferable that a material, such as glass, a ceramic material or the like that has a same rate of thermal expansion as that of the flow path forming substrate 10, is used for the above-described protection substrate 30. In this embodiment, the protection substrate 30 is formed by using a silicon monocrystal substrate that is formed from the same material as that of the flow path forming substrate 10.

A through hole 33 that passes through the protection substrate 30 in the thickness direction is formed in the protection substrate 30. In addition, a portion of each lead electrode 90 near the end portion extracted from each piezoelectric element 300 is disposed so as to be exposed to the inside of the through hole 33.

In addition, a driving circuit 120, that is used for driving the piezoelectric elements 300 arranged so as to be parallel to one another, is fixed on the protection substrate 30. As the driving circuit 120, for example, a circuit substrate, a semiconductor integrated circuit (IC), or the like may be used. In addition, the driving circuit 120 and the lead electrodes 90 are electrically connected to each other through a connection wiring 121 that is formed of a conductive wire such as a bonding wire.

A compliance substrate 40 that is formed of a sealing film 41 and a fixing plate 42 are bonded on the protection substrate 30. Here, the sealing film 41 is formed of a flexible material with low rigidity (for example, a poly phenylene sulfide (PPS) film with a thickness of 6 μm), and one-side face of the reservoir portion 31 is sealed by the sealing film 41. The fixing plate 42 is formed of a hard material (for example, stainless steel (SUS) or the like with a thickness of 30 μm) such as a metal. An area of the fixing plate 42 that faces the reservoir 100 is an opening portion 43 that is completely removed in the thickness direction. Accordingly, one-side face of the reservoir 100 is sealed only by the sealing film 41 which is flexible.

In the ink jet recording head of the first embodiment, the inside is filled with ink from the reservoir 100 up to the nozzle opening 21 by inserting ink from an ink introducing opening that is connected to an external ink supplying unit that is not shown in the figure, and then, a voltage is applied between the first electrode 60 and the second electrode 80 corresponding to each pressure generating chamber 12 in accordance with a recording signal transmitted from the driving circuit 120. The signal causes the elastic film 50, the insulating film 55, the first electrode 60, and the piezoelectric body layer 70 to be deformed so as to be bent. Accordingly, the pressure inside each pressure generating chamber 12 is increased, and whereby ink droplets are ejected from the nozzle opening 21.

Other Embodiments

An embodiment of the invention has been described as above. However, the basic configuration according to an embodiment of the invention is not limited thereto. For example, in the first embodiment described above, the first electrode 60 is formed by alloying or mixing platinum, titanium oxide, and iridium oxide. In an alternate configuration, however, a configuration may be used in which layers, each with the above-described materials are laminated together. Thus the first electrode 60 may be formed, for example, in a configuration where a adherence layer formed of titanium oxide, a platinum layer, a diffusion preventing layer of iridium oxide, and a crystal-type layer of titanium oxide are stacked together to from the insulating film 55 side. In such a configuration, for example, the specific permittivity of the titanium oxide is largely influenced by the crystal-type layer disposed on the piezoelectric body layer 70 side.

Furthermore, in the First Embodiment described above, a silicon monocrystal substrate of which the crystal plane orientation is the (110) plane forms the flow path forming substrate 10. However, the invention is not limited thereto. For example, a silicon monocrystal substrate of which the crystal plane orientation is the (100) plane may be used as the flow path forming substrate 10. Alternatively, a material such as an SOI substrate or glass may be used for the flow path forming substrate 10.

Furthermore, in the First Embodiment described above, the piezoelectric element 300 in which the first electrode 60, the piezoelectric body layer 70, and the second electrode 80 are sequentially stacked on the substrate (flow path forming substrate 10) is used. However, the invention is not limited thereto. Thus, for example, the invention may be applied to a piezoelectric element of a vertically vibrating type in which a piezoelectric material and an electrode forming material are alternately stacked so as to expand or contract in the axial direction.

Figure 10:
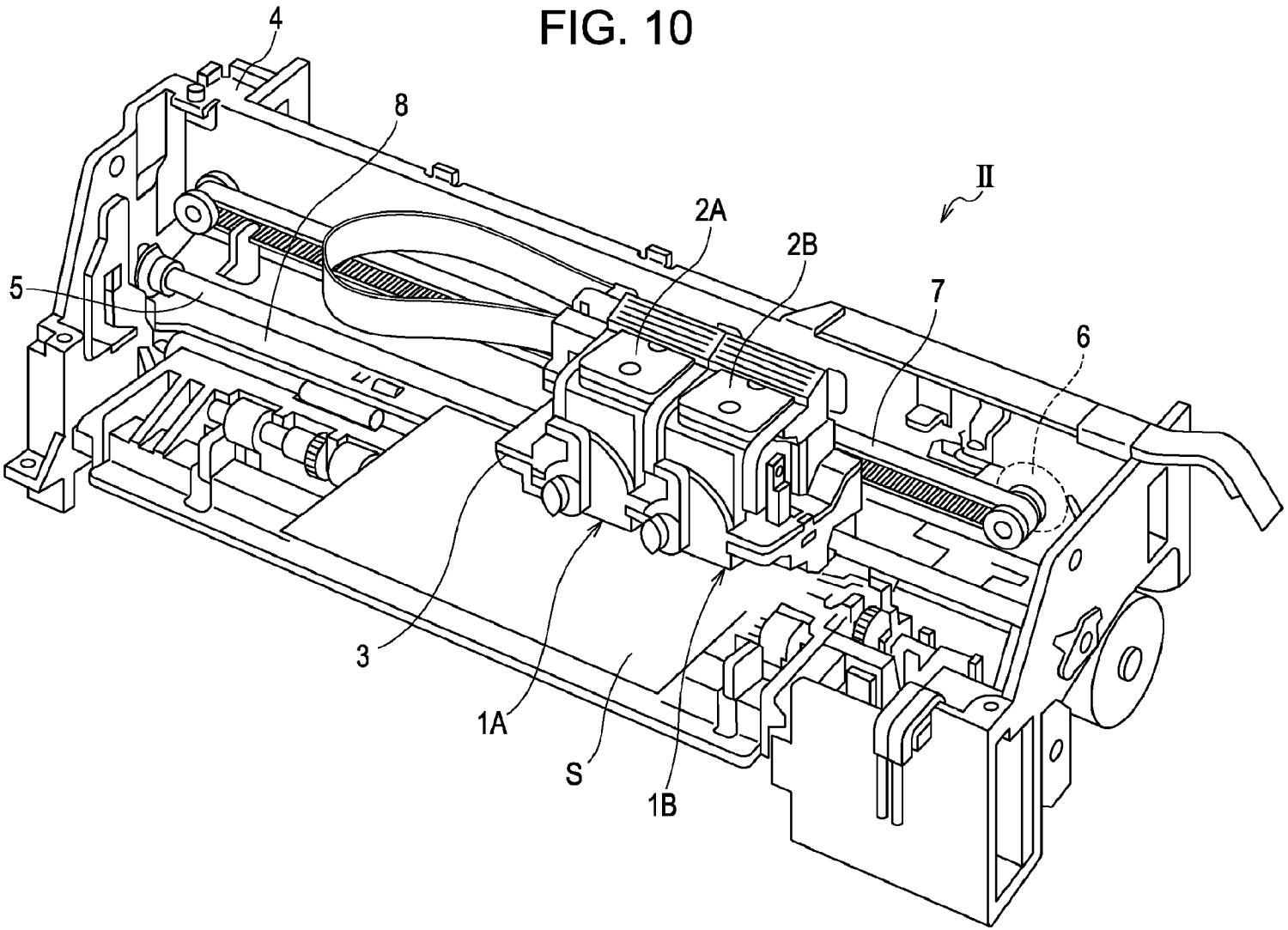
FIG. 10 is a diagram showing a schematic configuration of a recording apparatus according to a second embodiment of the invention.

In addition, the ink jet recording head configures a part of a recording head unit that includes an ink flowing path communicating with an ink cartridge or the like and is mounted in an ink jet recording apparatus. FIG. 10 is a schematic diagram showing an example of the ink jet recording apparatus.

In an ink jet recording apparatus II shown in FIG. 10, cartridges 2A and 2B, which configure the ink supplying unit, are disposed so as to be able to be attached to and detached from recording head units 1A and 1B with the ink jet recording heads I. In addition, a carriage 3 in which the recording head units 1A and 1B are mounted is disposed in a carriage shaft 5, which is installed to an apparatus main body 4, so as to be able to freely move in the shaft direction. These recording head units 1A and 1B, for example, are assumed to eject a black ink composition and a color ink composition.

Then, as the driving force of a driving motor 6 is transferred to the carriage 3 through a plurality of gears which is not shown in the figure and a timing belt 7, the carriage 3 in which the recording head units 1A and 1B are mounted is moved along the carriage shaft 5. On the other hand, a platen 8 is disposed along the carriage shaft 5 in the apparatus main body 4. A recording sheet S that is a recording medium such as paper, which is fed by a paper feed roller (not shown) while being wound around the platen 8.

In addition, in the above-described ink jet recording apparatus II, the ink jet recording head I (head units 1A and 1B) are described to be mounted on the carriage 3 and move in the main scanning direction as an example. However, the invention is not limited thereto. Thus, for example, the invention can be applied to a so-called line-type recording apparatus in which the ink jet recording head I is fixed and printing is performed only by moving a recording sheet S such as a paper sheet in the sub scanning direction.

In addition, in the First Embodiment described above, the ink jet recording head has been described using an example of a liquid ejecting head. However, the invention may be used in a variety of liquid ejecting heads and a broad meaning and may also be applied to liquid ejecting heads that eject liquid other than ink. As other types of liquid ejecting heads, for example, there are various recording heads that are used for an image recording apparatus such as a printer, a coloring material ejecting head that is used for manufacturing a color filter of a liquid crystal display or the like, an electrode material ejecting head that is used for forming an electrode of an organic EL display, an FED (electric-field emission display), or the like, a bioorganic material ejecting head that is used for manufacturing a bio chip, and the like.

In addition, the invention is not limited to a piezoelectric element mounted in a liquid ejecting head that is represented by an ink jet recording head and may be applied to a piezoelectric actuator that is mounted in any other apparatus.

What is claimed is:

1. A liquid ejecting head comprising:
- a pressure generating chamber that communicates with a nozzle opening; and
- a piezoelectric element that includes:
  - a first electrode;
  - a piezoelectric body layer that is formed above the first electrode and which has a perovskite structure with a general formula of $ABO_3$; and
  - a second electrode that is formed above the piezoelectric body layer,
- wherein there is lead in a B site of the piezoelectric body layer, and
- wherein the peak position of $A_1$(3LO) for a Raman shift of the piezoelectric body layer that is acquired by Raman scattering is 710 $cm^{-1}$ to 712 $cm^{-1}$.

2. The liquid ejecting head according to claim 1, wherein the piezoelectric body layer contains zirconium and titanium.

3. The liquid ejecting head according to claim 2, wherein the ratio of titanium in the piezoelectric body layer to the sum of titanium and zirconium is between 0.464 and 0.6.

4. The liquid ejecting head according to claim 1, wherein the first electrode contains platinum.

5. A liquid ejecting apparatus comprising the liquid ejecting head according to claim 1.

6. A piezoelectric actuator comprising:
- a first electrode;
- a piezoelectric body layer that is formed above the first electrode and which has a perovskite structure with a general formula of $ABO_3$; and
- a second electrode that is formed above the piezoelectric body layer,
- wherein there is lead in a B site of the piezoelectric body layer, and
- wherein the peak position of $A_1$(3LO) for a Raman shift of the piezoelectric body layer that is acquired by Raman scattering is 710 $cm^{-1}$ to 712 $cm^{-1}$.

7. The piezoelectric actuator according to claim 6, wherein the piezoelectric body layer contains zirconium and titanium.

8. The piezoelectric actuator according to claim 7, wherein the ratio of titanium in the piezoelectric body layer to the sum of titanium and zirconium is between 0.464 and 0.6.

9. The piezoelectric actuator according to claim 6, wherein the first electrode contains platinum.

10. A liquid ejecting apparatus comprising:
- an ink supply;
- an ink supply flowing path; and
- a liquid ejecting head comprising:
  - a pressure generating chamber that communicates with the ink supply flowing path so that ink is supplied from the ink supply to a nozzle opening; and
  - a piezoelectric element that includes:
    - a first electrode;
    - a piezoelectric body layer that is formed above the first electrode and which has a perovskite structure with a general formula of $ABO_3$; and
    - a second electrode that is formed above the piezoelectric body layer, wherein there is lead in a B site of the piezoelectric body layer, and wherein the peak position of $A_1$(3LO) for a Raman shift of the piezoelectric body layer that is acquired by Raman scattering is 710 $cm^{-1}$ to 712 $cm^{-1}$.

11. The liquid ejecting apparatus according to claim 10, wherein the piezoelectric body layer contains zirconium and titanium.

12. The liquid ejecting apparatus according to claim 11, wherein the ratio of titanium in the piezoelectric body layer to the sum of titanium and zirconium is between 0.464 and 0.6.

13. The liquid ejecting apparatus according to claim 10, wherein the first electrode contains platinum.

* * * * *